United States Patent [19]

Martinmaas

[11] 4,214,491

[45] Jul. 29, 1980

[54] QUICKLY ADJUSTABLE RATCHET WRENCH

[76] Inventor: Werner W. Martinmaas, 650 South Rock Blvd., Unit 3, Reno, Nev. 89502

[21] Appl. No.: 62,892

[22] Filed: Aug. 1, 1979

Related U.S. Application Data

[63] Continuation of Ser. No. 909,104, May 24, 1978, abandoned.

[51] Int. Cl.[3] ..... B25B 13/14

[52] U.S. Cl. ..... 81/134; 81/142

[58] Field of Search ..... 81/130 R, 130 A, 134, 81/135, 142, 143, 157, 159, 355, 359, 360

[56] References Cited

U.S. PATENT DOCUMENTS

| | | | |
|---|---|---|---|
| 1,159,428 | 11/1915 | Sokolov | 81/157 |
| 1,434,753 | 11/1922 | Shackford . | |
| 1,452,668 | 4/1923 | Wettwer | 81/135 X |
| 1,720,650 | 7/1929 | Purdy | 81/142 X |
| 2,587,320 | 2/1952 | Hogstadius | 81/143 X |
| 2,970,502 | 2/1961 | Nordgren . | |
| 3,000,245 | 9/1961 | Orr | 81/142 X |
| 3,232,150 | 2/1966 | Allegraud | 81/143 |
| 4,106,372 | 8/1978 | Miller | 81/143 |

*Primary Examiner*—James G. Smith

*Attorney, Agent, or Firm*—Wegner, Stellman, McCord, Wiles & Wood

[57] ABSTRACT

A quickly adjustable ratchet wrench is essentially a crescent wrench modified by eliminating the adjusting screw and substituting a locking member and a lever to engage and disengage the locking member with the rack on the movable wrench jaw. A tension spring lightly biases the movable jaw toward closed position. With the locking member disengaged from the rack the movable jaw may be manually opened, and when the movable jaw is released the light spring bias closes the jaws on a bolt head. When the wrench jaws are engaged with a bolt head, rotation of the lever arm against a rearward extension that replaces the wrench handle engages the locking member with the rack to turn the bolt, while rotation of the lever arm away from the extension disengages the locking member and permits the jaws to open against the light spring bias and slip over the angles of the bolt head; thus eliminating the need to remove and replace the wrench on the bolt head.

23 Claims, 8 Drawing Figures

QUICKLY ADJUSTABLE RATCHET WRENCH

CROSS REFERENCE TO RELATED APPLICATION

This application is a continuation of applicant's copending application Ser. No. 909,104 filed May 24, 1978, now abandoned.

BACKGROUND OF THE INVENTION

A feature of socket wrenches which makes them very easy to use is the one-way ratchet connection between the wrench handle and the socket receiving stub, so that once a wrench socket is engaged with a bolt head the handle can be turned clockwise to tighten the bolt and turned counterclockwise to start a new stroke without having to disconnect the socket from the bolt head. Socket wrenches, however, have the disadvantage that a different socket is required for each size bolt head.

There are several varieties of adjustable wrenches, but to the best of applicant's knowledge all adjustable wrenches must be disengaged from a bolt head and re-engaged on each stroke. This is particularly time-consuming where the location of the bolt to be tightened is such that nearby obstructions limit the length of the wrench stroke and thus necessitate frequent disconnection and reconnection of the wrench with the bolt head. In this respect adjustable wrenches are similar to spanners, hex wrenches and box wrenches.

SUMMARY OF THE INVENTION

The principal object of the present invention is to provide an adjustable wrench which may be rotated clockwise to tighten the bolt; and which may be turned counterclockwise to start a new stroke without disengaging the wrench from the bolt head or returning the bolt to the position that it occupied before the stroke was started.

Another object of the invention is to provide an adjustable wrench which may be quickly opened and closed upon the head of a bolt which is to be tightened.

The foregoing objects of the invention are realized by constructing a quickly adjustable ratchet wrench having the following elements:

a fixed jaw member having a jaw element;

a movable jaw member having a jaw element and an elongated engaging surface;

means mounting said movable jaw member for linear translatory movement on the fixed jaw member between closed and open positions of said jaw elements;

a jaw spring lightly biasing said movable jaw member toward closed position so that said fixed and movable jaw elements normally close lightly upon an object between them;

locking means supported on the fixed jaw member including a locking face which is selectively engageable with said engaging surface to lock the jaw elements closed upon an object between them; and a lever pivoted on the fixed jaw member which constitutes the sole means for engaging and disengaging said engaging surface and said locking face, said lever having a transverse surface which bears on a part of the fixed jaw member when the engaging surface and the locking face are engaged so that manual force applied to the lever is transmitted through the fixed jaw member to rotate an object upon which the jaws are closed, and which pivots away from said part of the fixed jaw member to disengage said engaging surface and locking face and thereby release the movable jaw member for free linear movement against the bias of the spring, said lever being so related to the fixed jaw member that a user may manually grip the lever with one hand while leaving the fixed jaw member free, whereby the movable wrench jaw may be alternately locked solely by rotation of the lever in one direction to grip opposite flat surfaces of an object between the jaw elements to rotate said object and released solely by rotation of the lever in the other direction for free rotation of the jaw elements around angles between adjacent flat surfaces of the object without rotating said object.

To simplify the detailed description and claims, the operation of the wrench is described as it is used to tighten a bolt. To loosen or remove a bolt, of course, the position of the wrench on the bolt is reversed so that the working stroke is counterclockwise and the idle stroke is clockwise.

Further, the term "lightly biasing" with reference to the biasing springs is used as a general limitation upon the force with which the movable jaw of the wrench may be biased toward closed position. The biasing force must be small enough that when the lever arm is rotated counterclockwise to start a new working stroke, the jaws can open sufficiently against the spring bias to slip around the angles of the bolt head instead of loosening the bolt. This, of course, limits the biasing force that can be applied to the movable jaw by the spring.

The engaging surface of the movable jaw member is shown in the drawings as a toothed rack, and the locking face is shown with lugs engaging the rack; and those terms are usually employed hereinafter.

The present device is called a ratchet wrench as a matter of convenience, and not as a precise definition of function; because it does not operate as does a conventional ratchet. When the lever arm is rotated counterclockwise to release the locking lugs from the rack teeth to start a new stroke of the wrench, the locking lugs merely retract from the teeth; and as the jaws spread to go around the angles of the bolt head the rack moves a short distance relative to the locking member. When the jaws again close upon opposite flat sides of the bolt head the rack returns to its original position, and the locking lugs re-engage with the same teeth upon renewed clockwise rotation of the wrench. For practical purposes the wrench may be thought of as a ratchet wrench; but in fact it does not, mechanically, operate as does a ratchet.

THE DRAWINGS

DETAILED DESCRIPTION OF THE INVENTION

Figures 1, 2, 3, 4:
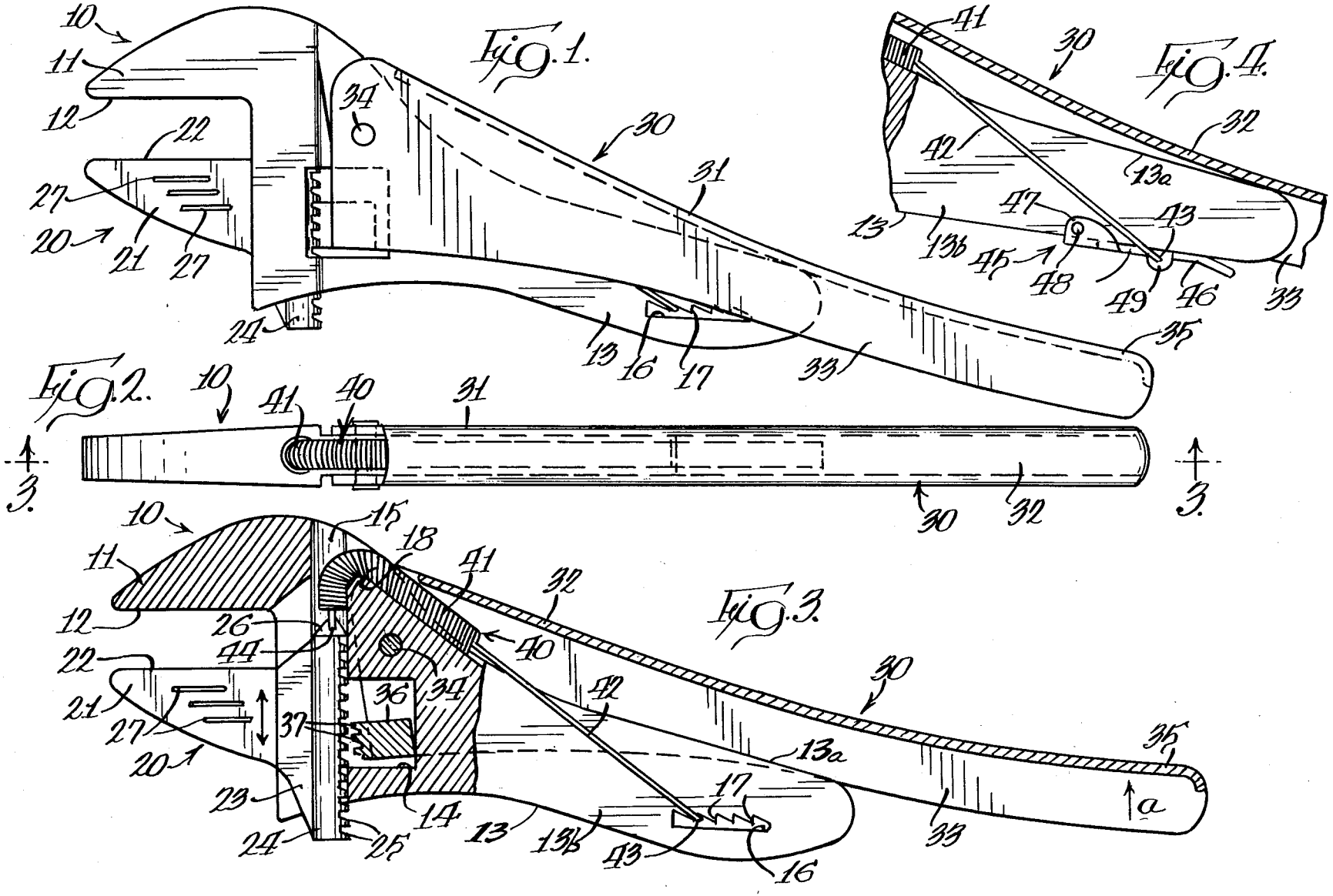
FIG. 1 is a side elevational view of a first embodiment of the invention with the lever arm and locking member in their operative position.
FIG. 2 is a plan view of the preferred form of the invention.
FIG. 3 is a sectional view taken substantially as indicated along the line 3—3 of FIG. 2, with the lever arm rotated counterclockwise to release the locking member from engagement with the rack on the movable jaw member.
FIG. 4 is a fragmentary sectional view similar to FIG. 3, illustrating a second embodiment of the invention which has a cam lever to quickly release tension of the jaw spring for easier manual movement of the movable jaw.

Referring to the drawings in greater detail, and referring first to FIGS. 1 to 3, the first embodiment of the quickly adjustable ratchet wrench of the present invention consists, generally, of a fixed jaw member, indicated generally at 10; a movable jaw member, indicated generally at 20, manually releasable locking means, indicated generally at 30; and a jaw spring, indicated generally at 40.

The fixed jaw member 10 has a fixed jaw element 11 at its forward portion, and the fixed jaw element has a gripping surface 12. An integral rearward extension 13 on the fixed jaw member 10 takes the place of the handle of the crescent wrench and has a back surface **13*a* and side surfaces 13*b*; and there is a forwardly open recess 14 at the front of the handle below the plane of the gripping surface 12. A slideway 15 is positioned between the fixed jaw element 11 and the recess 14**.

Toward the rear of the extension 13 is an elongated opening 16 which extends entirely across the extension 13, and in the top of the opening is a series of lugs 17 which permit adjustment of the biasing force applied by the jaw spring 40.

Adjacent the upper end of the slideway 15 the fixed jaw member 10 has a smoothly curved transverse surface 18 which is grooved to accommodate the jaw spring 40 and merges into the back surface **13*a* of the extension 13**.

The movable jaw member 20 includes a movable jaw element 21 with a gripping surface 22 which closes against the gripping surface 12 of the fixed jaw element 11; and to the rear of the movable jaw element 21 is a vertically extended supporting portion 23 by means of which the movable jaw member 20 is carried in the slideway 15 for linear translatory movement so as to open and close the jaws 11-21.

At the extreme rear of the movable jaw member 20 is an elongated engaging surface 24 in the form of a rack having teeth 25 which traverse the front of the recess 14 as the jaw member 20 is moved in the slideway 15.

The elements as heretofore described are essentially the same as those in a conventional crescent wrench, except for the elongated slot 16 and lugs 17 of the handle 13, and the smoothly curved transverse surface 18 to accommodate the jaw spring 40. In addition, as illustrated in the drawings, the rearward extension 13 is much shorter than a conventional crescent wrench handle. In a crescent wrench an adjusting screw occupies the recess 14 and engages the rack teeth 25 in order that the position of the movable jaw member 20 may be adjusted by manual rotation of the screw. In the present structure the screw is eliminated; and the manually releasable locking means 30 and the jaw spring 40 are substituted.

The movable jaw member 20 has an upright spring anchor 26 surmounting the supporting portion 23; and the sides of the movable jaw element 21 are provided either with grooves or ribs 27 to facilitate manual movement of the movable jaw member 20 against the light biasing force applied by the jaw spring 40. Addition of the spring anchor 26 and the grooves or ribs 27, and a change in spacing of the rack teeth, as hereinafter described, comprise the only changes from a conventional crescent wrench movable jaw.

The manually releasable locking means 30 includes a lever 31 which is of channel shape with a back web 32 providing a transverse surface overlying the back surface **13*a* of the extension 13 and side webs 33 the more forward portions of which flank the extension 13 and receive a pivot pin 34 which extends through both side webs 33 and the fixed jaw member 10 immediately above the recess 14. The lever 31 has a lever arm 35 which extends a substantial distance to the rear of the extension 13**.

A locking member 36 is fixedly mounted between the lever side webs 33 in the recess 14, and has a locking face in the form of a plurality of locking lugs 37 which engage with adjacent teeth 25 of the rack 24 when the lever 31 is in the position of FIG. 1 in which its back web 32 abuts the back surface of the extension 13. It is apparent that the rack teeth 25 and the locking lugs 37 are merely exemplary of suitable structure. The longitudinal surface 24 of the movable jaw, and the locking face could be transversely striated, or otherwise roughened enough to prevent slippage between the movable jaw member 20 and the locking member 36.

Counterclockwise movement of the lever arm 35 away from the extension 13, as indicated by the arrow a in FIG. 3, moves the locking member from the operative position of FIG. 1, in which its locking lugs 37 are engaged with the teeth 25, to the idle position of FIG. 3 in which the movable jaw member 20 is free to slide in the slideway 15.

The jaw spring 40 is anchored to the extension 13 of the fixed jaw member 10 and lightly biases the movable jaw member 20 toward closed position. Specifically, the jaw spring 40 constitutes a coil tension spring 41 at one end of which is an elongated fastener 42 with a hook 43 that engages one of the lugs 17; and at the other end the coil spring 41 has a hook 44 which engages the spring anchor 26 at the top of the movable jaw member 20. Thus, the biasing force exerted upon the movable jaw member 20 depends upon which of the lugs 17 is engaged by the spring anchoring hook 43. The coil spring 41 extends around the smoothly curved transverse surface 18 adjacent the slideway 15; and the top of the fixed jaw member 10 cooperates with the back web 32 of the lever 31 to protect the spring 41 in case somebody uses the back of the wrench as a hammer.

When the wrench is to be used, the lever arm 35 is rotated counterclockwise to release the movable jaw 20, which may then be manually moved so that the space between the gripping surfaces 12 and 22 is slightly greater than the span across a bolt head to be engaged, and the lever arm 35 is then returned to its position with the back web 32 abutting the back surface **13*a* of the rearward extension 13 to maintain this setting of the movable jaw member 20. The wrench is then positioned with the gripping surfaces 12 and 22 at opposite sides of the bolt head, and the lever arm is again moved to release the movable jaw so that the jaw spring closes the movable jaw against the bolt head. Clockwise rotation of the lever arm 35 then applies force through the locking lugs 37 and the rack teeth 25 to turn the bolt in the direction to tighten it. When a first stroke of the wrench is completed, light counterclockwise pressure on the rearward portion of the lever arm 35 that extends behind the handle 13 will disengage the locking lugs 37 from the teeth 25 so that the movable jaw element 21 is free to move away from the fixed jaw element 11 against the light bias of the jaw spring 41 so that the gripping surfaces 12 and 22 of the jaws may slip around the angle of the bolt head and again close upon the opposite flat sides of the bolt head; whereupon another clockwise stroke of the lever arm 35** further tightens the bolt.

In order that the locking lugs may properly engage the rack teeth 25 when the jaw gripping surfaces 12 and 22 are closed upon a bolt head, the space between the teeth 25 and the corresponding space between the locking lugs 37 are coordinated with the span across the flat sides of bolt heads of different sizes, so that the lugs and the teeth are engaged when the gripping surfaces are fully closed upon the flat sides of a bolt head.

Referring now to FIG. 4, the second embodiment of the invention is identical with the first except for the fact that the slot 16 and lugs 17 are eliminated so that the biasing force of the jaw spring means 40 is not adjustable; and instead a spring release means, indicated generally at 45, is added to the structure. The spring release means consists of a small cam lever 46 which has ears 47 flanking the rearward extension 13 so that the cam lever may be mounted upon a pivot 48. A spring anchoring eye 49 toward the rear end of the lever 46 receives the jaw spring anchoring hook 43.

When the movable jaw member 20 is to be manually adjusted, the camming lever 46 may be swung forwardly about the pivot 48, as indicated by the arrow, so as to eliminate the tension on the coil spring 41 or reduce it so much that the movable jaw member 20 will remain at any position to which it is manually moved. After the jaw elements are in position flanking a bolt head, return of the camming lever 46 to its original position illustrated in FIG. 4 tensions the coil spring 41 to slide the movable jaw member 20 into gripping position so that the gripping surfaces 12 and 22 are closed upon two opposite flat sides of the bolt head.

Figures 5, 6, 7, 8:
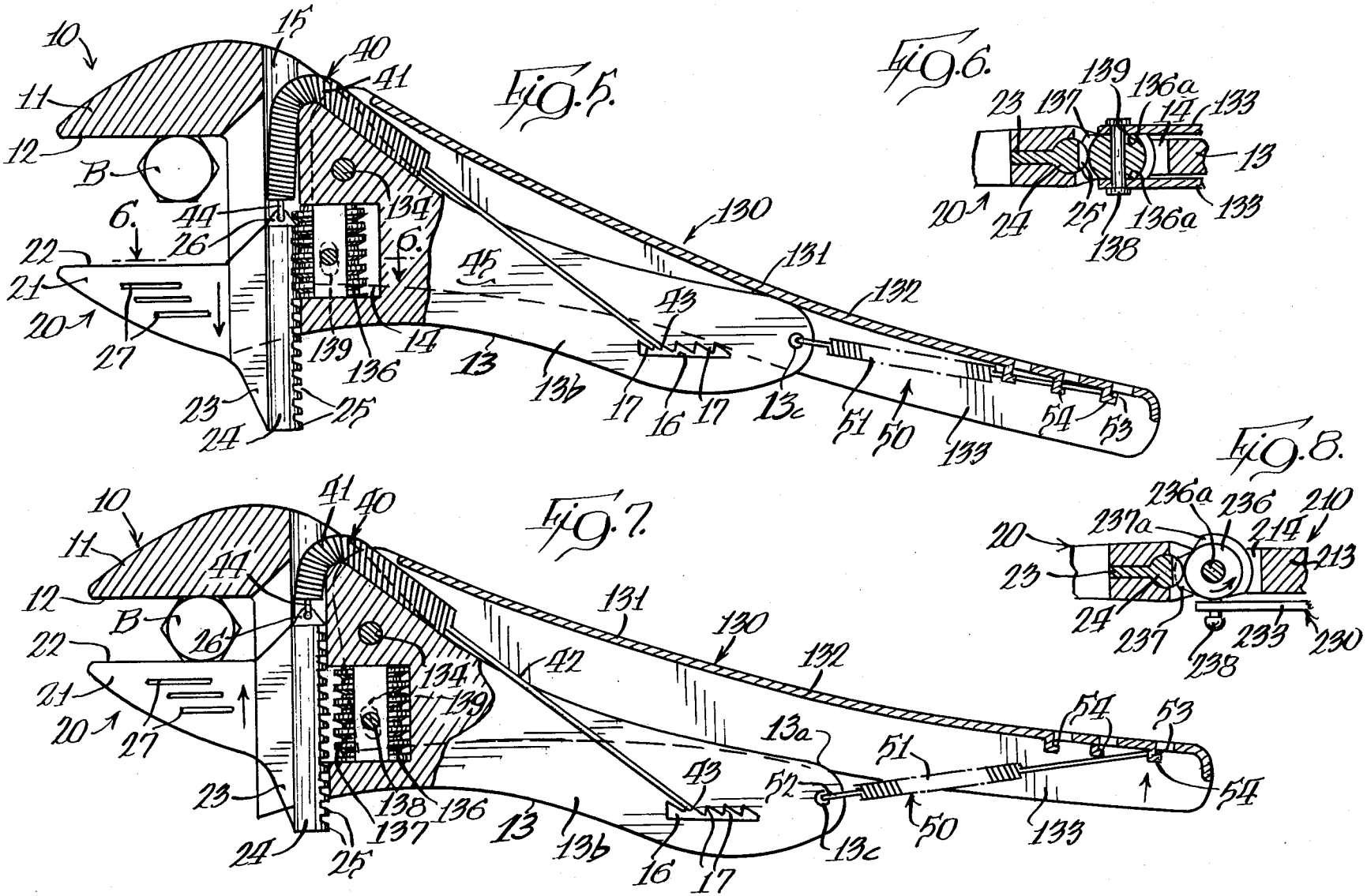
FIG. 5 is a view similar to FIG. 3, illustrating a third embodiment of the invention with the locking member engaged with the rack.
FIG. 6 is a fragmentary sectional view taken substantially as indicated along the line 6—6 of FIG. 5.
FIG. 7 is a view like FIG. 5, illustrating the third embodiment with the lever arm rotated counterclockwise and the locking member disengaged from the rack.
FIG. 8 is a view like FIG. 6, illustrating a fourth embodiment of the invention.

Referring now to FIGS. 5 to 7, the third embodiment of the invention has a fixed jaw member 10, a movable jaw member 20, and jaw spring means 40 which are identical with those in the first embodiment; so those parts are not described in detail at this time and they are all given reference numerals identical with those used for the first embodiment. The modifications in the third embodiment are principally in the manually releasable locking means, indicated generally at 130 in FIGS. 5 to 7. In addition, the third embodiment includes adjustable lever spring means, indicated generally at 50.

The manually releasable locking means 130 includes a lever 131 which is like the lever 31 except for the fact that the locking member is not integrally connected with the side webs 133 of the lever. Instead, a separate locking member 136 is similar to the adjusting screw for a conventional crescent wrench, so the locking lugs 137 are like a screw thread which is interrupted by flat sides **136*a* on the locking member 136. Interengaging means on the locking member 136 and the lever 131 consists of a double headed pin 138 which fits snugly in a transverse bore in the locking member 136 and is received in upright slots 139 in the side webs 133 of the lever. As a result, when the lever is turned about its pivot 134 from the operative position of FIG. 5 to the idle position of FIG. 7, the locking member 136 is moved rearwardly in the recess 14 so as to disengage the locking lugs 137 from the teeth 25 of the rack 24**.

The lever spring means 50 lightly biases the lever 131 clockwise to normally retain it in the position of FIG. 5, so that the locking member 136 is automatically returned to its operative position when the lever arm is relieved of counterclockwise force. The lever spring means consists of a coil spring 51 which has engaging means 52 in the form of a hook engaged with a hole **13*c* at the extreme rear of the rearward extension 13, and engaging means 53 in the form of an eye which may be selectively engaged with any of a series of spaced hooks 54 which are shear formed in the back web 132 of the lever arm 131**.

The difference in structure between the first form and the third form of the invention causes the latter to be used somewhat differently. When the movable jaw 20 of the first embodiment has been moved manually to a position such as that illustrated in FIG. 5, it is necessary in using that embodiment to manually return the lever arm to the position illustrated in FIG. 1. On the other hand, with the third embodiment the lever spring 51 automatically returns the lever arm to the position of FIG. 5 in order to retain the movable jaw member 20 in the illustrated open position as soon as counterclockwise rotational force is taken off the lever arm. As a result, the third embodiment may be positioned relative to a bolt head B, as seen in FIG. 5, without the need for manually holding the movable jaw member 20 in its extreme open position. Counterclockwise movement of the lever arm 131 then releases the rack teeth 25 so that the jaw spring means 40 can slide the movable jaw element 21 into engagement with the bolt head B; after which the lever arm 131 can be released for return to the position of FIG. 5 by the lever spring means 50.

Referring now to FIG. 8, the fourth embodiment of the invention comprises a fixed jaw member, indicated generally at 210, which includes a rearward extension 213 provided with a recess 214 in which a locking member 236 is mounted for pivotal movement about an axis of mounting means **236*a* which may be either a pivot post fixed in the top and bottom of the recess 214, or integral mounting bosses on the ends of the locking member 236 which seat in complementary sockets in the top and bottom of the recess 214. Except for requiring the mountings for the rotatable locking member 236 in the recess 214, the fixed jaw member 210 is identical with the fixed jaw member 10 of the first three embodiments of the invention. Furthermore, the movable jaw member 20 is identical with that of the first three embodiments, and accordingly the parts of that member which are illustrated in FIG. 8 are given the same reference numerals as the corresponding parts in FIGS. 1 to 6**.

A lever, indicated generally at 230, is similar to the levers 30 and 130, except for the fact that its side webs 233 are particularly constructed to accommodate the rotatable locking member 236 and to receive a pin 238 of interengaging means by which movement of the lever 230 from a position such as that illustrated in FIG. 5 to a position such as that illustrated in FIG. 7 pivots the locking member 236 to disengage lugs 237 of a semicylindrical locking face from the rack teeth 25 and positions a release face **237*a* opposite the rack teeth so as to release the engaging surface of the movable jaw member from the locking face of the rotatable locking member. In order to permit pivoting of the locking member 236, the lugs 237 of the locking face are also cut away adjacent the side web 233 of the lever 230**.

Except for the movement by which the locking member 236 is disengaged from the engaging surface of the movable jaw member 20, the fourth embodiment of the invention may be like either the first embodiment or the third embodiment in the way in which it is used.

The foregoing detailed description is given for clearness of understanding only and no unnecessary limitations should be understood therefrom as modifications will be obvious to those skilled in the art.

I claim:

1. A quickly adjustable ratchet wrench for rotating objects which have angularly related flat surfaces surrounding an axis of rotation, said wrench comprising, in combination:

a fixed jaw member having a jaw element;

a movable jaw member having a jaw element and an elongated engaging surface;

means mounting said movable jaw member for linear translatory movement of the fixed jaw member between closed and open positions of said jaw elements;

a jaw spring lightly biasing said movable jaw member toward closed position so that said fixed and movable jaw elements normally close lightly upon an object between them;

locking means supported on the fixed jaw member including a locking face which is selectively engageable with said engaging surface to lock the jaw elements closed upon an object between them; and a lever on the fixed jaw member which constitutes the sole means for engaging and disengaging said engaging surface and said locking face, said lever having a forward part which is channel-like with side webs flanking the fixed jaw member, a transverse pivot pin extending through the side webs to pivot the lever on said fixed jaw member, and a transverse web which bears on a part of the fixed jaw member when the engaging surface and the locking face are engaged so that manual force applied to the lever is transmitted through the fixed jaw member to rotate an object upon which the jaws are closed, and which pivots away from said part of the fixed jaw member to disengage said engaging surface and locking face and thereby release the movable jaw member for free linear movement against the bias of the spring, said lever being so related to the fixed jaw member that a user may manually grip the lever with one hand while leaving the fixed jaw member free, whereby the movable wrench jaw may be alternately locked solely by rotation of the lever in one direction to grip opposite flat surfaces of an object between the jaw elements to rotate said object and released solely by rotation of the lever in the other direction for free rotation of the jaw elements around angles between adjacent flat surfaces of the object without rotating said object.

2. A quickly adjustable ratchet wrench for rotating objects which have angularly related flat surfaces surrounding an axis of rotation, said wrench comprising, in combination:

a fixed jaw member having a jaw element and a rearward extension which has a back surface;

a movable jaw member having a jaw element and an elongated engaging surface;

means mounting said movable jaw member for linear translatory movement on the fixed jaw member between closed and open positions of said jaw elements;

a jaw spring lightly biasing said movable jaw member toward closed position so that said fixed and movable jaw elements normally close lightly upon an object between them;

locking means including a locking face on the fixed jaw member which is selectively engageable with said engaging surface to lock the jaw elements closed upon an object between them; and a lever pivoted on the fixed jaw member for engaging and disengaging said engaging surface and said locking face, said lever having a transverse surface which bears on said rearward extension of the fixed jaw member when the engaging surface and the locking face are engaged so that manual force applied through the lever against said rearward extension rotates an object upon which the jaws are closed, and which pivots away from said back surface to disengage said engaging surface and locking face and thereby release the movable jaw member for free linear movement against the bias of the spring, said lever being so related to said rearward extension that a user may manually grip the lever with one hand while leaving the rearward extension free to permit manual reciprocation of the wrench with the movable wrench jaw alternately locked to grip opposite flat surfaces of an object between the jaw elements to rotate said object and released for free rotation of the jaw elements around angles between adjacent flat surfaces of the object without rotating said object.

3. The combination of claim 2 which includes a recess below the lever pivot, and in which the locking means including a locking face comprises a locking member mounted in said recess and movable by the lever, and the engaging surface of the movable jaw member traverses the front of the recess facing the locking face.

4. The combination of claim 3 in which the locking member is integral with the forward part of the lever.

5. The combination of claim 4 in which the locking member is movable in the recess, and interengaging means on the locking member and on the lever moves said locking member when the lever is pivoted.

6. The combination of claim 5 in which the locking member is mounted for sliding movement in the recess and the interengaging means slides said member toward and away from the engaging surface.

7. The combination of claim 5 in which the locking member is pivotable about an axis parallel to the line of movement of the movable jaw member, the locking face is a segment of a cylinder, a release face adjacent the locking face is on a chord cut through said cylinder, and the interengaging means pivots the locking member to selectively position the locking face in cooperative relationship to the engaging surface, or to position the release face toward the engaging surface.

8. The combination of claim 2 in which the jaw spring is a tension spring which has one end anchored to the fixed jaw member and the other end secured to the top of the movable jaw member.

9. The combination of claim 8 in which the jaw spring is long, the fixed jaw member has a smoothly curved transverse surface at its upper end, and the jaw spring curves around said transverse surface and has said end anchored to the rearward extension.

10. The combination of claim 9 which includes means on the rearward extension for adjusting the biasing force of the jaw spring.

11. The combination of claim 10 in which said adjusting means comprises a series of lugs on the rearward extension and said one end of the jaw spring is selectively engageable with any one of said lugs.

12. The combination of claim 9 which includes means on the rearward extension for selectively releasing tension on the jaw spring to facilitate movement of the movable jaw member.

13. The combination of claim 12 in which the tension releasing means comprises a pivoted camming lever, and said one end of the jaw spring is secured to said camming lever so that in one position of the camming lever the jaw spring exerts more biasing force than it does in another position of said camming lever.

14. The combination of claim 9 in which the upper part of the fixed jaw member and the forward part of the lever cooperate to form a spring guard.

15. The combination of claim 2 which includes a lever spring lightly biasing the lever arm into abutment with the rearward extension.

16. The combination of claim 15 which includes means for adjusting the biasing force of the lever spring.

17. The combination of claim 16 in which the lever spring is a tension spring which has engaging means at a first end connected to the rearward extension and engaging means at a second end connected to the lever arm, and in which the means for adjusting the biasing force comprises a series of spaced hooks to any one of which one of said jaw spring engaging means may be detachably secured.

18. The combination of claim 2 in which the engaging surface comprises a toothed rack and the locking face has lugs engaging said rack.

19. The combination of claim 18 in which the spacing of the rack teeth is correlated to the span of standard bolt heads of various sizes.

20. The combination of claim 2 in which the lever is substantially longer than the rearward extension.

21. The combination of claim 2 in which the lever is channel-shaped with a back web providing said transverse surface which bears upon a back surface of the rearward extension and side webs flanking side surfaces of said rearward extension.

22. The combination of claim 2 which includes means on the fixed jaw which is operatively connected to the jaw spring to adjust the biasing force of said jaw spring.

23. The combination of claim 2 which includes means on the fixed jaw which is operatively connected to the jaw spring to selectively release tension on said jaw spring.

* * * * *